United States Patent [19]

Hatt

[11] Patent Number: 4,913,444

[45] Date of Patent: Apr. 3, 1990

[54] REVERSIBLE DART BOARD

[76] Inventor: Lee R. Hatt, 6516 Bikini Way, Sarasota, Fla. 34241

[21] Appl. No.: 252,673

[22] Filed: Oct. 3, 1988

[51] Int. Cl.[4] ..... F41J 3/00

[52] U.S. Cl. ..... 273/408; 273/409

[58] Field of Search ..... 273/408, 407, 409, 403, 273/144 B, 138 R; 40/120, 124.4, 122

[56] References Cited

U.S. PATENT DOCUMENTS

| | | | |
|---|---|---|---|
| 2,039,352 | 5/1936 | Ross | 273/407 |
| 2,510,629 | 6/1950 | Golden | 40/122 X |
| 3,048,401 | 8/1962 | Dishon | 273/408 |
| 3,088,738 | 5/1963 | Meyer | 273/407 X |
| 3,300,216 | 1/1967 | Haecker | 273/403 |

FOREIGN PATENT DOCUMENTS

| | | | |
|---|---|---|---|
| 3610137 | 10/1987 | Fed. Rep. of Germany | 273/408 |
| 855935 | 2/1940 | France | 273/409 |

OTHER PUBLICATIONS

Pocket-Pick's Lucky Number Advertising Circular 4-1984.

*Primary Examiner*—Paul E. Shapiro

*Attorney, Agent, or Firm*—Charles J. Prescott; Raymond H. Quist

[57] ABSTRACT

A reversible dart board has a frame with a raised periphery defining a target receiving space. The target has an obverse face divided into equal areas with each area marked with a different number from a first sequence of numbers. The target has a reverse face divided into equal areas with each area marked with a different number from a second sequence of numbers. The frame has a back portion with a cut-out area which one can use to push out the target. The raised periphery of the frame is preferably formed by folding extending areas of the back portion.

10 Claims, 2 Drawing Sheets

Fig. 1
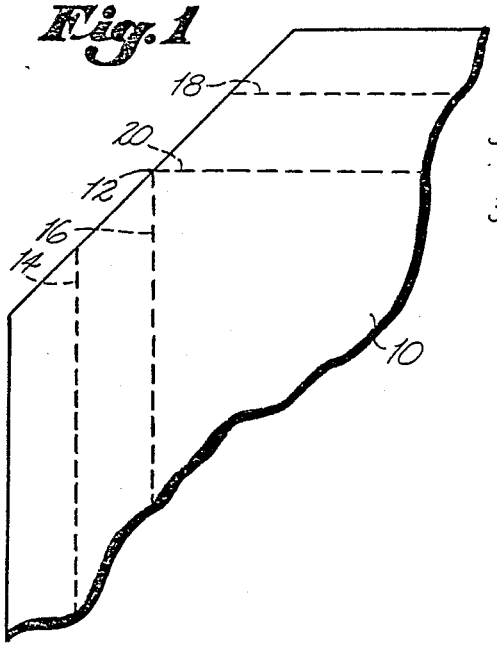
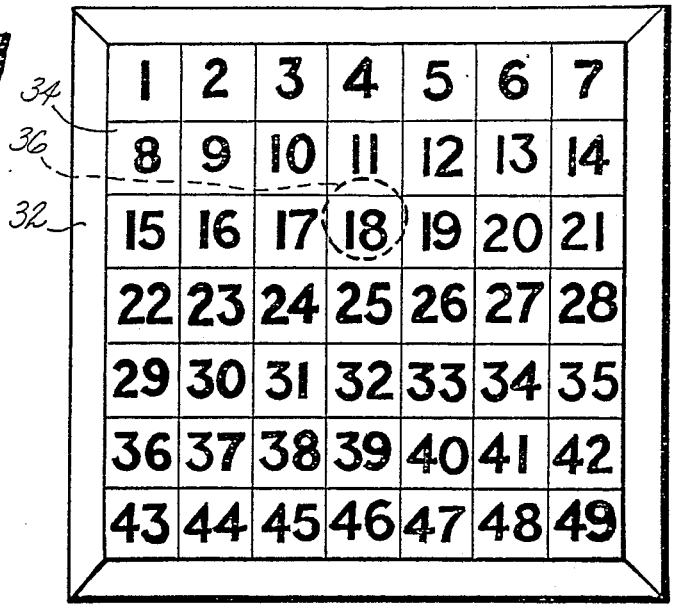
Fig. 6
Fig. 2
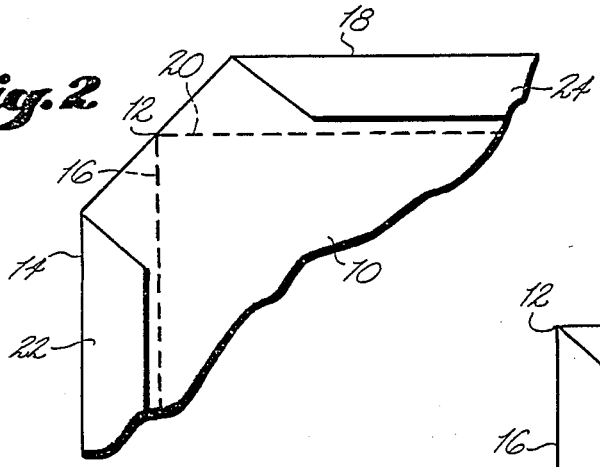
Fig. 3
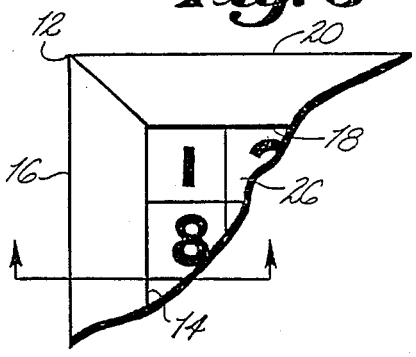
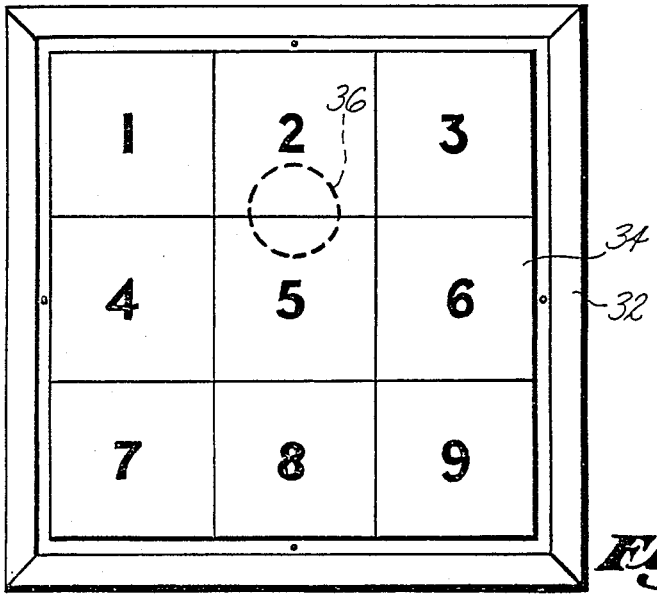
Fig. 7
Fig. 4
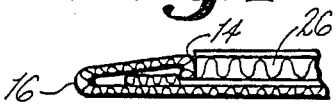
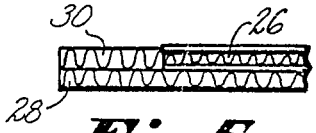
Fig. 5

REVERSIBLE DART BOARD

BACKGROUND OF THE INVENTION

1. Field of the Invention

This invention relates generally to dart boards, and in particular to a dart board having obverse and reverse target areas.

2. Description of Related Art

A number of states, including Florida, have sponsored games of chance as a method of raising revenue without the imposition of a tax. In Florida, one game is a lottery of a parimutuel type in which six numbers from the sequence beginning with 1 and ending with 49 are chosen in a random manner once each week. A player who has purchased a lottery ticket with the identical six numbers is a grand prize winner. Other prizes are given for matching five or four of the chosen numbers. A second Florida sponsored game involves correctly matching three randomly selected numbers from a sequence. Other states have other lottery type games involving the selection of numbers.

Although some players of these games have favorite numbers which they choose in buying tickets, many players prefer a more random selection of the numbers.

U.S. Pat. No. 4,314,703, Grottola, entitled: "Dart Game and Board" discloses a dart board having on one face fifty two equal areas, with each area marked as a different card from a bridge deck. The other face of the dart board is marked into areas marked as a different face of a six-sided die. Players compete by throwing darts to select hands of "cards" or throws of "dice". To reduce the element of skill or increase chance, the board may be rotated. This patented dart board includes a plywood core having cellulose face disks on both faces, and may also have fabric coverings.

The present reversible dart board provides a target having an obverse face having equal areas marked with the numbers from the sequence 1 through 49, and a reverse face having equal areas marked with the numbers from the sequence 0 through 9. A frame is provided in which target can be removably held with either the obverse or reverse face displayed. The dart board is of economical construction, making it an expendible item.

SUMMARY OF THE INVENTION

A target of square configuration has an obverse face divided into equal areas with each area marked with a different number from a first sequence of numbers. The target also has a reverse face divided into equal areas with each area marked with a different number from a second sequence of numbers. A frame is provided to releasably hold the target with either the obverse or reverse face exposed. The frame has a back portion and a raised peripheral front portion defining the target receiving space secured to the back portion. The target and frame are fabricated of material, such as cardboard, suitable for releasably holding a dart point.

It is therefore an object of this invention to provide a dart board for use in selecting numbers for playing state sponsored lottery type games.

It is also an object to provide a dart board having a target which can be reversed so that numbers from two sequences of numbers can be selected.

It is also an object of this invention to provide a dart board having a frame to hold the target with both the frame and target formed of material which will releasably hold a dart point.

In accordance with these and other objects, which will become apparent hereafter, the instant invention will now be described with reference to the accompanying drawings.

BRIEF DESCRIPTION OF THE DRAWINGS

FIG. 1 is a fragmentary view showing a corner of a preferred embodiment of a frame before it is formed.

FIG. 2 is a view of the frame fragment of FIG. 1. partially formed.

FIG. 3 is a view of the frame fragment of FIGS. 1 and 2 fully formed with a target portion held therein.

FIG. 4 is a cross-section, taken on the line 4—4 of FIG. 3.

FIG. 5 is a cross-section of a different embodiment of a region similar to that of FIG. 4.

FIG. 6 is an elevation of a dart board in accordance with the invention showing the obverse target face.

FIG. 7 is an elevation of a dart board in accordance with the invention showing the reverse target face.

DETAILED DESCRIPTION OF THE INVENTION

Figure 8:
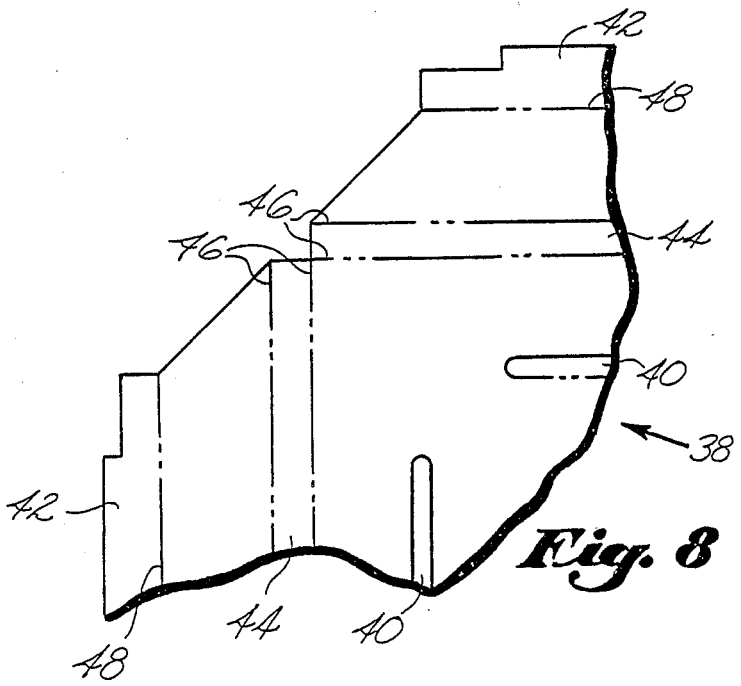
FIG. 8 is a fragmentary view of a blank for an alternate frame embodiment.

Referring to FIGS. 1–4, the manner in which a preferred frame is fabricated is depicted. A square sheet 10 of a material such as cardboard which will releasably hold a dart point, has four points, such as point 12 which will be corners of the finished frame. A diagonal cut through these points is made to remove unwanted material. Fold lines 14–20 are provided as shown in FIG. 1. First folds, such as folds 14 and 18, are made along each side of sheet 10. These first folds yield the result shown in FIG. 2. It should be noted that the edge of the folded material does not reach fold lines 16 and 20.

Folds along fold lines 16 and 20 are next made after first applying adhesive to surfaces 22 and 24. The frame then appears as shown in FIG. 3 with a raised peripheral portion best seen in FIG. 4. It should be noted that the inner fold 14 rises higher than outer fold 16. Also shown in FIGS. 3 and 4 is a portion of the target 26 which fits snugly against the raised peripheral portion of the frame.

In lieu of forming the raised peripheral portion of the frame by folding in edge extensions as described above, an alternative technique is shown in FIG. 5. The base portion 28 of the frame in this embodiment has the target space defined by separate strips of cardboard such as strip 30.

Turning to FIG. 6, a complete frame is depicted with the obverse face of target 34 within the defined target space. A cut-out-area 36 is included on the back portion of frame 32 to facilitate pushing out target 34 from frame 32. It will be observed that the obverse face of target 34 has markings to divide it into forty nine equal areas, with each area containing a separate number from the sequence of numbers one through forty nine. This sequence, as previously indicated, is that used in the Florida lottery. The target face may be divided into a different number of equal areas for different sequences of numbers.

FIG. 7 shows frame 32, including cut-out area 36, and target 34 with the reverse face showing. In this case, the target face is divided into ten equal areas and each area contains a different number from the sequence zero through nine. Note that the zero area is a margin about the other nine areas.

In addition to holding the target 34, frame 32 provides additional dart receiving area for darts which miss the target. This tends to reduce damage to a wall or other surface on which the reversible dart board is mounted. Also, the cut-out portion 36 of the frame may be used to hang the dart board on a nail or the like. Alternatively, a nail o tack through frame 32 may be used to secure the dart board to a wall.

Although, the dart board of this invention could be fabricated of more conventional dart board material, such as cork, the use of cardboard permits economical manufacture. Also, the dart board may be relatively small (a reversible dart board which is nominally a nine inch square has been fabricated). These factors permit the dart board to be considered an expendable item which can be discarded without significant economic loss after it becomes substantially worn.

Figure 9:
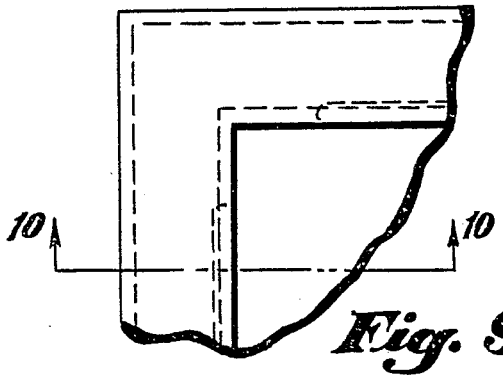
FIG. 9 shows the fragment of FIG. 8 as folded.
Figure 10:
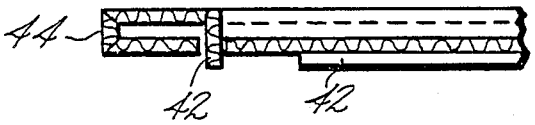
FIG. 10 is a cross-section taken on the line 10—10 of FIG. 9.

Turning now to FIGS. 8–10, an alternate frame embodiment which does not require adhesive will be described. A blank 38 is formed as shown in FIG. 8 which includes slots 40 and cooperating tabs 42 which fit into slots 40. Frame edges 44 are formed by folding blank 38 on fold lines 46. Fold lines 48 are used to make an inner frame edge and to position tabs 42 in slots 40.

While the instant invention has been shown and described herein in what is conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

I claim:

1. A reversible dart board comprising:

a rectilinear frame having a back portion and a raised peripheral front portion secured to said back portion defining a target receiving space;

said raised peripheral front portion being adhesively secured to said back;

a target sized to fit snugly within said target receiving space;

said target having an obverse target face divided into a first plurality of equal areas;

said target having a reverse target face divided into a second plurality of equal areas different from said first plurality of equal areas;

each area in said first plurality of equal areas containing a different number from a first sequence of numbers; and each area in said second plurality of equal areas containing a different number from a second sequence of numbers.

2. A reversible dart board in accordance with claim 1 wherein:

said back portion includes a cut-out area through which said target can be pushed, facilitating removal of said target from said frame.

3. A reversible dart board in accordance with claim 1 wherein:

both said frame and said target are fabricated of material suitable for releasably holding a dart point.

4. A reversible dart board in accordance with claim 3 wherein:

said material is cardboard.

5. A reversible dart board in accordance with claim 1 wherein:

said back portion of said frame has four edges and each edge has an extension;

said raised peripheral portion is formed by folding said extensions parallel to the respective edges.

6. A reversible dart board in accordance with claim 5 wherein:

said extensions are folded two times.

7. A reversible dart board in accordance with claim 1 wherein:

said raised peripheral portion is formed by separate strips of material.

8. A reversible dart board in accordance with claim 1 wherein:

said first sequence of numbers is from one to forty nine inclusive; and said second sequence of numbers is from one to nine inclusive.

9. A reversible dart board in accordance with claim 1 further including:

slots in said back portion;

tabs formed on said frame to extend through said slots when said frame is formed.

10. A reversible dart board comprising:

a rectilinear frame having a back portion and a raised peripheral front portion secured to said back portion defining a target receiving space;

said back portion of said frame having four edges and each edge having an extension;

said raised peripheral portion is formed by folding said extensions parallel to the respective edges;

said extensions are folded two times;

said raised peripheral portion is adhesively secured to said back portion;

said back portion includes a cut-out area through which said target can be pushed, facilitating removal of said target from said frame;

a target sized to fit snugly within said target receiving space;

said target having an obverse target face divided into a first plurality of equal areas;

said target having a reverse target face divided into a second plurality of equal areas different from said first plurality of equal areas;

each area in said first plurality of equal areas containing a different number from a first sequence of numbers;

each area in said second plurality of equal areas containing a different number from a second sequence of numbers; and both said frame and said target are fabricated of material suitable for releasably holding a dart point.

* * * * *